US010024320B2

(12) United States Patent
Morris

(10) Patent No.: US 10,024,320 B2
(45) Date of Patent: Jul. 17, 2018

(54) PRODUCTION TUBING AND PUMP DRIVER CONTROL LINES COMBINATION FOR SUSPENDING PROGRESSIVE CAVITY PUMP AND PUMP DRIVER IN A PRODUCTION ASSEMBLY

(75) Inventor: Collin Rickey Morris, Lloydminster (CA)

(73) Assignee: CJS Production Technologies Inc., Lloydminster (CA)

( * ) Notice: Subject to any disclaimer, the term of this patent is extended or adjusted under 35 U.S.C. 154(b) by 1417 days.

(21) Appl. No.: 13/885,460

(22) PCT Filed: Sep. 13, 2011

(86) PCT No.: PCT/CA2011/050553

§ 371 (c)(1),
(2), (4) Date: Jul. 18, 2013

(87) PCT Pub. No.: WO2012/071667

PCT Pub. Date: Jun. 7, 2012

(65) Prior Publication Data

US 2013/0294906 A1 Nov. 7, 2013

Related U.S. Application Data

(60) Provisional application No. 61/419,443, filed on Dec. 3, 2010.

(51) Int. Cl.
*F04C 13/00* (2006.01)
*F04C 18/00* (2006.01)
(Continued)

(52) U.S. Cl.
CPC ..... *F04C 18/00* (2013.01); *E21B 17/20* (2013.01); *E21B 43/129* (2013.01); *F04C 13/008* (2013.01); *F04C 2/1071* (2013.01)

(58) Field of Classification Search
CPC ..... E21B 17/20; E21B 43/129
(Continued)

(56) References Cited

U.S. PATENT DOCUMENTS 4,361,937 A 12/1982 Davis
5,145,007 A 9/1992 Dinkins
(Continued)

FOREIGN PATENT DOCUMENTS

FR 2556404 6/1985
JP 2003147758 5/2003
(Continued)

*Primary Examiner* — Taras P Bemko
(74) *Attorney, Agent, or Firm* — Ryan W. Dupuis; Ade + Company Inc.; Kyle R. Satterthwaite

(57) ABSTRACT

A hydrocarbon production rotary pump having a stator and a rotor drive to rotate therein by a submersible pump driver is supported so as to be suspended from a wellhead by a support member including production tubing and at least one control line alongside the production tubing. The control line(s) has greater tensile strength in the longitudinal direction of the well casing than the production tubing such that the control line(s) provides greater support to the rotary pump and the submersible pump driver than the production tubing. A unitary casing in the form of a seamless material may fully surround the production tubing and the control line(s) along the full length thereof.

18 Claims, 3 Drawing Sheets

(51) Int. Cl.
*E21B 17/20* (2006.01)
*E21B 43/12* (2006.01)
*F04C 2/107* (2006.01)

(58) Field of Classification Search
USPC ..... 166/105
See application file for complete search history.

(56) References Cited

U.S. PATENT DOCUMENTS

| | | | | |
|---|---|---|---|---|
| 5,553,666 | A | 9/1996 | Hartman | |
| 2005/0189029 | A1* | 9/2005 | Quigley | E21B 17/20 138/125 |
| 2007/0000682 | A1* | 1/2007 | Varkey | H01B 7/046 174/102 |
| 2008/0196902 | A1* | 8/2008 | Head | E21B 33/1275 166/381 |
| 2009/0277628 | A1* | 11/2009 | Watson | F04D 13/10 166/250.01 |

FOREIGN PATENT DOCUMENTS

| | | |
|---|---|---|
| KR | 20100125027 | 11/2010 |
| WO | 2011150213 | 12/2011 |

* cited by examiner

PRODUCTION TUBING AND PUMP DRIVER CONTROL LINES COMBINATION FOR SUSPENDING PROGRESSIVE CAVITY PUMP AND PUMP DRIVER IN A PRODUCTION ASSEMBLY

This application claims the benefit under 35 U.S.C. 119(e) of U.S. provisional application Ser. No. 61/419,443, filed Dec. 3, 2010.

FIELD OF THE INVENTION

The present invention relates to a method of suspending a progressive cavity pump and submersible pump driver at the bottom of the production tubing of a production assembly by providing control lines for operating the pump driver alongside the production tubing such that the control lines have greater tensile strength and provide greater support than the production tubing.

BACKGROUND

Currently production tubing for progressive cavity pumps is comprised of various types of steel, commonly in the form of jointed tubing. This is for several reasons. Mainly it is because progressive cavity pumps are run with an additional rod string that is run inside of the jointed tubing to drive the pump rotation. The rods take up a lot of space, and therefore in order to minimize pressure drops, large internal diameter tubes are typically used, especially when high viscosity fluids are involved.

Another reason is to withstand the torque of the rods. The rods which are run inside the tubing turn the rotor portion of the pump, while the stator portion which is connected to the tubing remains stationary. This creates large amounts of torque, which the production pipe must withstand.

Another reason is for tensile strength as the pipe, rods, pump and fluid can be very heavy, so steel is required for tensile purposes.

Unfortunately steel is more susceptible to corrosion than composites and plastics, and when a small hole caused by corrosion in the production tubular occurs, the entire string would need to be replaced, which is obviously not desirable because of the cost.

Accordingly, there is a need in the oil and gas industry to replace jointed production systems that rely on rods and jointed tubing. To this end it is desirable to deploy a hydraulic submersible progressive cavity pump (HSPCP) which is run down hole by a hydraulically driven motor driver as described in the applicant's co-pending patent application.

When deploying a HSPCP and driver, the need for much of these tensile and torque strengths are vastly reduced by running the system down hole. This allows for the deployment of composite or steel alternative materials. These types of alternative materials would be advantageous for corrosion control, and surface friction reduction.

An encased member may be provided which incorporates both the hydraulic conduits and the production conduit; however, for cost reasons, it may be desirable from time to time to use smaller hydraulic conduits encased together or as individual strings in combination with separate and independent alternative material continuous production tubing. This is because, in many situations, due to the high viscosity of the fluid, the production tube is much larger than the necessary hydraulic conduit tubes and the all inclusive encased member surrounding the production tubing and hydraulic conduits can get large and unnecessarily expensive.

SUMMARY OF THE INVENTION

According to one aspect of the invention there is provided a method of operating a rotary pump having a stator and a rotor driven to rotate therein by a submersible pump driver connected to the rotary pump in a production assembly suspended in a well casing from a wellhead, the method comprising:

Providing production tubing extending in a longitudinal direction of the well casing so as to be in communication between the wellhead and the rotary pump;

providing at least one control line extending alongside the production tubing so as to be arranged to communicate a drive input from the wellhead to the submersible pump driver to drive rotation of the rotary pump and such that said at least one control line has greater tensile strength in the longitudinal direction of the well casing than the production tubing; and suspending the rotary pump and the submersible pump driver in a production position in the well casing from the production tubing and said at least one control line such that said at least one control line provides greater support to the rotary pump and the submersible pump driver than the production tubing.

When using a hydraulic driver, the rods and tubing can be eliminated. In one embodiment, the driver can be deployed using an umbilical string which consists of at least two conduits for the hydraulic circuit and one conduit for the production conduit as a common encased member. In this instance, the hydraulic conduit preferably provides tensile/vertical support. These hydraulic tubes are most usually steel. The production tubing can thus be made out of plastic, or some other composite type tubular, and be of a larger O.D. than the hydraulic injectors while being adequately supported. The larger O.D. on the production tube is because the production fluid has a high viscosity, and larger tubulars will normally be needed for the production string than the hydraulic injectors, as the hydraulic oil has a much lower viscosity, and space inside the casing is always a prime concern. The composite production tubular is also advantageous because it is much lighter than large diameter steel. If steel were used as the production conduit, very large deployment equipment would be necessary especially once the hydraulic conduits were introduced. Because of the large diameter production tube, and the smaller diameter hydraulic injectors, this type of umbilical support member will typically be shaped instead of having a flat face profile. The support member will preferably have a uniform thickness of jacket that covers and follows the contours of all the hydraulic control lines and the production tubing, resulting in a shaped profile. This shaped profile minimizes excessive cost due to extra encapsulation material, and facilitates running gear (chains) that will not crush the larger production tube.

In other embodiments for the case of very large production tubing it may be desirable to use production tubing which is separate from the hydraulic conduits such as alternative material tubing or existing production tubing. The hydraulic conduits or control lines in this instance may be integrally joined or provided as individual tubes to both supply the hydraulic conduit to the driver, and support the weight of the alternative material, as it is unlikely that large alternative materials could be ran to the necessary depths and support their own weight, much less that of the hydraulic conduits as well. This means that the smaller member locating the hydraulic conduits therein would actually be the string bearing the tensile loads during production and deployment instead of conventional production assemblies where normally the larger strings bear these tensile loads.

This system would require only a coiled tubing unit to deploy the string of hydraulic conduits, and a slave reel for the larger (but lighter) alternative material production tubing. The progressive cavity pump and driver would be connected to the continuous alternative product (likely composite tubing, fibreglass tubing, or other), then the hydraulic conduit tube would be connected to the driver portion of the HSPCP as per usual. The hydraulic conduits would then be injected into the wellbore while pulling the larger, steel-alternative production tubing into the wellbore simultaneously. It would also be advantageous to stop at intervals and strap/clamp the production tubing to the hydraulic conduits that are bearing all the loads. This is to ensure vertical support.

Once at depth, the hydraulic strings carrying the load would be landed or secured first, as to ensure the production string, which is a continuous string of steel alternative material, is well supported prior to it being terminated and secured.

According to one embodiment, the two control lines are defined by respective conduits and a casing is provided which comprises a seamless material integrally surrounding the two control lines substantially along a full length thereof separate from the production tubing. In this instance the method preferably includes strapping the casing to the production tubing at spaced apart intervals in the longitudinal direction.

In an alternative embodiment, the control lines may be joined to the production tubing by providing a casing comprising a seamless material fully surrounding the production tubing and said at least one control line substantially along a full length thereof. The control line preferably has a greater tensile strength than the casing in this instance.

According to another aspect of the present invention there is provided a support member for supporting a rotary pump and a submersible pump driver in a production assembly in a well casing, the support member comprising:

a production tubing member arranged to extend in a longitudinal direction between the rotary pump and a wellhead of the well casing for communicating production fluids upwardly therethrough;

at least one control line extending alongside the production tubing so as to be arranged to communicate a drive input from the wellhead to the submersible pump driver so as to drive rotation of the rotary pump; and a unitary casing comprising a seamless material fully surrounding the production tubing and said at least one control line substantially along a full length thereof;

said at least one control line having greater tensile strength in the longitudinal direction than the production tubing and the unitary casing such that said at least one control line provides greater support to suspend the rotary pump and the submersible pump driver in the well casing than the production tubing.

Preferably a diameter of the production tubing is greater than a diameter of said at least one control line.

The control lines preferably comprise two control lines defined by respective metallic conduits and a casing comprising a seamless material integrally surrounding the two control lines substantially along a full length thereof.

Preferably the two control lines comprise a first material and the seamless material of the casing comprises a second material which is elastomeric such that the first material has a greater tensile strength than the second material.

The production tubing may be continuous and spoolable and comprise a plastic or composite material which is more corrosion resistant than steel production tubing and which has a coefficient of friction which is less than a coefficient of friction of steel production tubing.

The two control lines may be positioned on diametrically opposing sides of the production tubing such that respective central axes of the production tubing and the two control lines are aligned in a common plane. When a diameter of the production tubing is greater than a diameter of each control line, the casing preferably comprises a central body portion locating the production tubing centrally therein and a pair of side body portions locating the two control lines respectively therein at diametrically opposing sides of the central body portion in which the side body portions have a reduced thickness in a direction perpendicular to the common plane in relation to the central body portion. Preferably the casing has a substantially uniform thickness about each of the production tubing and the two control lines.

Some embodiments of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
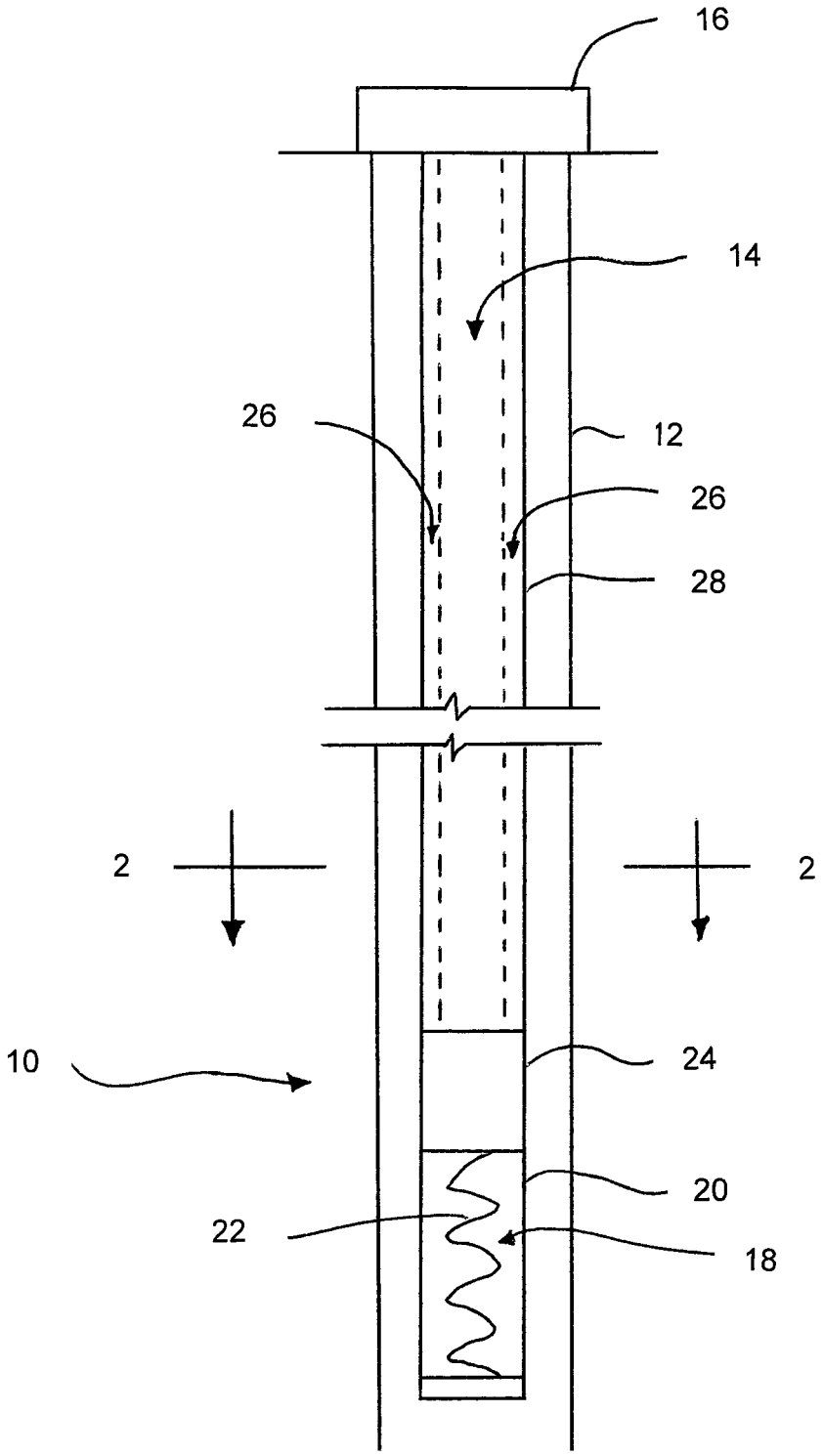
FIG. 1 is a partly sectional elevational view of a production assembly according to a first embodiment of the present invention.

Referring to the accompanying figures there is illustrated a hydrocarbon production assembly 10 suspended in a well casing 12 of a production well. Although two embodiments are described and illustrated herein, the common features of the two embodiments will first be described.

The production assembly 10 comprises a production tubing string 14 which extends in the longitudinal direction of the well casing between the wellhead 16 and the pump 18 at the bottom of the tubing string in the production zone of the well.

The pump 18 comprises a progressive cavity pump having a stator 20 fixed in relation to the surrounding housing and to the production tubing 14 and a rotor 22 rotatable within the stator. The rotor and stator includes lobes which interact with one another when the rotor 22 is rotated eccentrically in a forward direction of rotation relative to the stator to pump fluid upwardly from the production zone of the well casing through the production tubing 14 to the wellhead 16.

The rotor 22 of the pump is driven to rotate by a hydraulic submersible progressive cavity pump driver 24 connected in series between the stator 20 of the pump and the production tubing. The driver 24 includes a supply port arranged to receive a supply of hydraulic fluid and a return port arranged to return hydraulic fluid in a circuit. The flow of hydraulic fluid in the circuit drives an internal impeller of the driver 24 which causes a rotary output of the driver 24 to be rotated about a respective vertical output axis. A suitable drive link connects the output of the driver 24 to the rotor of the pump to transfer the rotation of the rotary output of the driver to the rotation of the rotor within the stator of the progressive cavity pump.

Two control lines 26 are provided which extend alongside the production tubing in the longitudinal direction of the well casing for controlling operation of the driver 24. The control lines 26 are externally located in relation to the internal passage of the production tubing. Each control line comprises a respective tubular conduit for conveying hydraulic fluid therethrough between the wellhead and a respective port of the driver 24. One of the conduits comprises a supply conduit and the other comprises a return conduit to form the hydraulic circuit of the driver 24 in communication between the driver and respective supply and return connections of a hydraulic fluid pump at the well head. The control lines 26 thus serve to convey a drive input from the well head to the down hole driver 24.

The control lines 26 are smaller in diameter than the production tubing 14 but are formed of steel or other strong material having an overall tensile strength which is much greater than the overall tensile strength of the production tubing so that the control lines 26 provide substantially all of the support to suspend the pump 18 and the driver 24 in the production position in the production zone of the well casing.

Depending upon the material used for the production tubing, the control lines 26 may also support some of the weight of the production tubing in addition to supporting the pump and driver.

In the illustrated embodiments a casing 28 is provided which fully surrounds the two control lines 26 so that the control lines are joined with one another and form a single support member extending in the longitudinal direction of the well casing. The casing 28 comprises a solid core of elastomeric material which is seamless and is formed of like material integrally throughout the cross section of the casing by extruding the material of the casing about the metallic tubular conduits forming the two control lines. The elastomeric material of the casing has much less tensile strength than the control lines and does not contribute to supporting the pump and driver within the well casing.

The production tubing 14 is formed of a plastic or composite material. Alternatively the tubing may be formed of a material having a plastic or composite lining. In either instance, the inner surface of the production tubing is more corrosion resistant than steel production tubing typically used while also having an inner surface with a lower coefficient of friction than typical steel production tubing. The tensile strength of the production tubing when formed of plastic or composite material is less than the two control lines even when the production tubing is larger in diameter and has more material so that the control lines remain substantially supporting the pump and driver.

Figure 2:
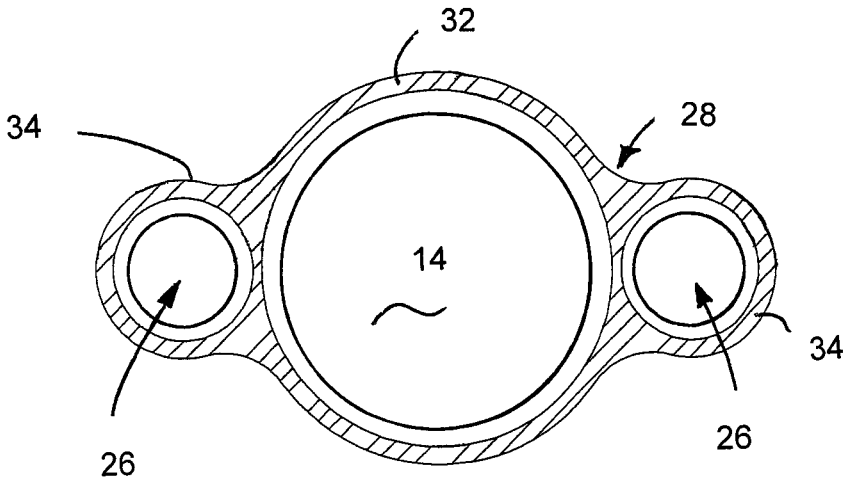
FIG. 2 is a sectional view of the support member along the line 2-2 of the production assembly according to FIG. 1.
Figure 3:
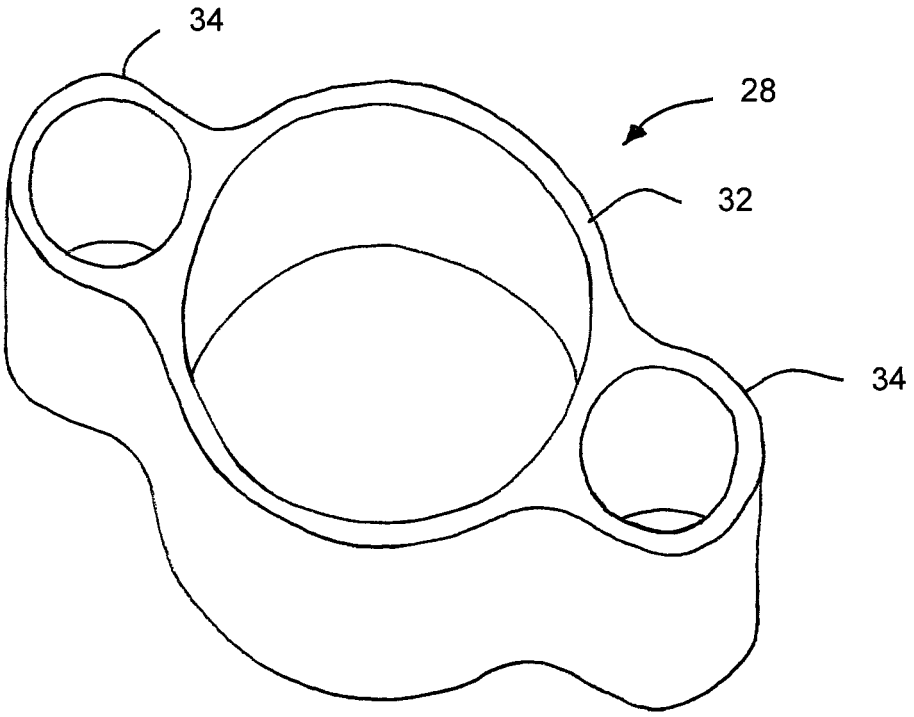
FIG. 3 is a perspective view of a section of the support member according to FIG. 2.

Turning now to the embodiment of FIGS. 1 through 3, the production tubing 14 and the two control lines 26 in this instance are commonly joined with one another by arranging the casing 28 to fully surround both control lines and the production tubing as well. The casing in this instance thus includes a central body portion 32 locating the production tubing centrally therein as well as a pair of side body portions 34 which locate the smaller outer diameter control lines 26 respectively therein at diametrically opposing sides of the central body portion 32. The production tubing 14 and the two control lines 26 are positioned relative to one another such that a central axis of each of the production tubing and control lines all lie together in a common plane. Accordingly, the central axes of the two control lines 26 are aligned along a common diametrical axis of the production tubing at diametrically opposing sides of the tubing.

The central body portion 32 has a uniform thickness around the production tubing while the two side body portions 34 have the same uniform thickness around the respective control lines 26 such that the elastomeric material forming the casing generally has a common thickness between inner and outer surfaces throughout. Due to the smaller outer diameter of the control lines relative to the production tubing, the overall width of the two side body portions is less than the overall width of the central body portion when measuring the overall width of the combined support member in a direction which is perpendicular to the common plane of the central axes of the production tubing and control lines. Due to the uniform thickness of the casing material throughout, the resulting outer surface of the combined support member is shaped to match the profile of a central larger tubing member with two smaller tubing members on opposing sides thereof in which the two side body portions 34 form lobes projecting from diametrically opposing sides of the central body portion.

The construction of the overall support member comprising the production tubing, the control lines, and the surrounding casing with a minimum uniform thickness of casing permits the design of running gear which can clamp the support member with the clamping force concentrated at the two side body portions with a minimum amount of compressive clamping force being transferred to the larger diameter central production tubing which has less strength than the metallic hydraulic conduits of the control lines.

Figure 4:
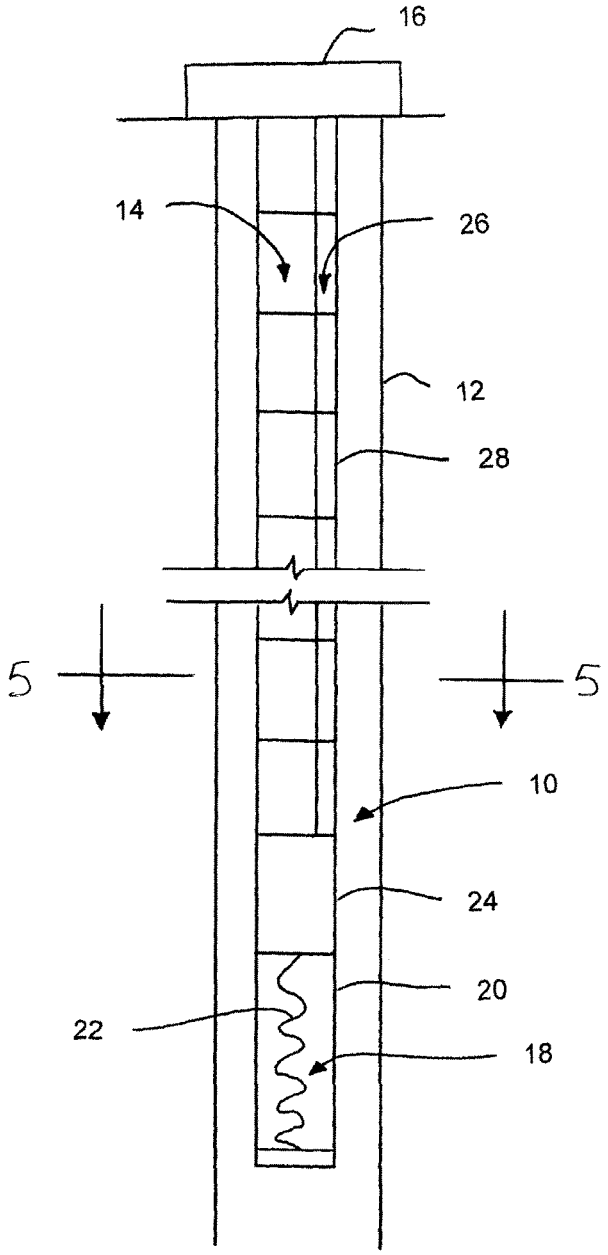
FIG. 4 is a partly sectional elevational view of the production assembly according to a second embodiment of the present invention.
Figure 5:
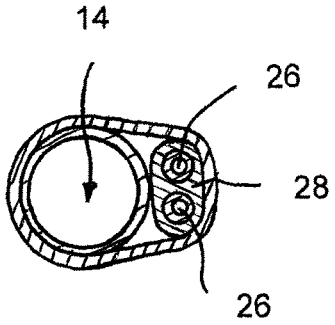
FIG. 5 is a sectional view of the support member along the line 5-5 of the production assembly according to FIG. 4.

Turning now to the embodiment of FIGS. 4 and 5, when it is desirable to use particularly large diameter production tubing, it is also desirable to separate the production tubing from the two control lines so as to minimize the overall cross section and cost of assembly of the combined support member described above. In this instance, the casing 28 only surrounds the two control lines. Due to the two control lines having the same diameter and being positioned directly adjacent one another the resulting shape of the casing is generally oval in shape with a substantially uniform thickness of elastomeric material surrounding the two control lines. In this instance, the production tubing can be spooled independently or in conjunction with the two control lines on a common coiled tubing unit. In either instance, the production tubing 14 is typically strapped to the support member locating the two control lines therein at spaced apart intervals in the longitudinal direction to provide support to the production tubing along the length thereof at the various connection points to the support member providing the tensile support to the production assembly.

In use, the rotor and stator of the pump are initially assembled and connected to the driver in the suitable manner prior to insertion into the well casing. The driver and pump are then connected to the production tubing 14 and to the two control lines 26 to be injected together into the well casing.

In the embodiment of FIGS. 1 through 3, the common support member locating the production tubing and the two control lines therein is spooled from a single coiled tubing unit so that the single support member is lowered down into the well casing to the production position at the production zone of the well casing. Circulating hydraulic fluid through the control lines then acts as the drive input to drive rotation of the driver and the pump rotor connected thereto for pumping fluids up through the production tubing.

The support member according to FIGS. 1 through 3 is a specialty type of umbilical which is designed for use with hydraulic submersible drivers where fluids, and more specifically high viscosity fluids, are being pumped to surface and require a very large diameter production conduit in comparison to the hydraulic tubes, and when that production tube has a lower collapse/crush rating than the hydraulic conduits.

According to the embodiment of FIGS. 4 and 5, the support member which locates only the control lines 26 therein in this instance is spooled from a master reel on the coiled tubing unit which carries the weight of the production assembly. A slave reel on the same coiled tubing unit spools the production tubing therefrom for injection into the well casing together with the injection of the support member from the master reel. The production tubing is strapped to the support member at spaced apart intervals as the support member and production tubing are lowered into the well casing.

In either embodiment the weight of the pump and pump driver are carried mostly or fully by the control lines while the production tubing may also contribute to some support or may itself be supported on the control lines as well.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A method of operating a rotary pump having a stator and a rotor driven to rotate therein by a submersible pump driver connected to the rotary pump in a production assembly suspended in a well casing from a wellhead, the method comprising:

providing production tubing extending in a longitudinal direction of the well casing so as to be in communication between the wellhead and the rotary pump;

providing at least one control line extending alongside the production tubing so as to be arranged to communicate a drive input from the wellhead to the submersible pump driver to drive rotation of the rotary pump and such that said at least one control line has greater tensile strength in the longitudinal direction of the well casing than the production tubing;

joining said at least one control line to the production tubing by providing a casing comprising a seamless material fully surrounding the production tubing and said at least one control line substantially along a full length thereof; and suspending the rotary pump and the submersible pump driver in a production position in the well casing from the production tubing and said at least one control line such that said at least one control line provides greater support to the rotary pump and the submersible pump driver than the production tubing.

2. The method according to claim 1 wherein a diameter of the production tubing is greater than a diameter of said at least one control line.

3. The method according to claim 1 wherein said at least one control line comprising a metallic conduit.

4. The method according to claim 1 wherein said at least one control line comprises two control lines defined by respective conduits and a casing comprising a seamless material integrally surrounding the two control lines substantially along a full length thereof.

5. The method according to claim 4 wherein the conduits of the two control lines comprise a first material and the seamless material of the casing comprises a second material which is elastomeric such that the first material has a greater tensile strength than the second material.

6. The method according to claim 1 wherein the production tubing is continuous and spoolable and comprises a plastic material.

7. The method according to claim 1 wherein the production tubing comprises a composite material.

8. The method according to claim 1 wherein the production tubing comprises a corrosion resistant material which is more corrosion resistant than steel production tubing.

9. The method according to claim 1 wherein the production tubing comprises a low friction material having a coefficient of friction which is less than a coefficient of friction of steel production tubing.

10. The method according to claim 1 wherein said at least one control line has a greater tensile strength than the casing.

11. The method according to claim 1 wherein said at least one control line comprises two control lines positioned on diametrically opposing sides of the production tubing such that respective central axes of the production tubing and the two control lines are aligned in a common plane, and wherein the casing comprises a central body portion locating the production tubing centrally therein and a pair of side body portions locating the two control lines respectively therein at diametrically opposing sides of the central body portion, the side body portions having a reduced thickness in a direction perpendicular to the common plane in relation to the central body portion.

12. The method according to claim 11 wherein a diameter of the production tubing is greater than a diameter of each control line and wherein the casing has a substantially uniform thickness about each of the production tubing and the two control lines.

13. A method of operating a rotary pump having a stator and a rotor driven to rotate therein by a submersible pump driver connected to the rotary pump in a production assembly suspended in a well casing from a wellhead, the method comprising:

providing production tubing extending in a longitudinal direction of the well casing so as to be in communication between the wellhead and the rotary pump;

providing at least one control line extending alongside the production tubing so as to be arranged to communicate a drive input from the wellhead to the submersible pump driver to drive rotation of the rotary pump and such that said at least one control line has greater tensile strength in the longitudinal direction of the well casing than the production tubing wherein said at least one control line comprises two control lines defined by respective conduits and a casing comprising a seamless material integrally surrounding the two control lines substantially along a full length thereof;

strapping the casing to the production tubing at spaced apart intervals in the longitudinal direction; and suspending the rotary pump and the submersible pump driver in a production position in the well casing from the production tubing and said at least one control line such that said at least one control line provides greater support to the rotary pump and the submersible pump driver than the production tubing.

14. A support member for supporting a rotary pump and a submersible pump driver in a production assembly in a well casing, the support member comprising:

a production tubing member arranged to extend in a longitudinal direction between the rotary pump and a wellhead of the well casing for communicating production fluids upwardly therethrough;

at least one control line extending alongside the production tubing so as to be arranged to communicate a drive input from the wellhead to the submersible pump driver so as to drive rotation of the rotary pump, said at least one control line comprising a pair of steel conduits arranged to convey hydraulic fluid therethrough; and a unitary casing comprising a seamless material fully surrounding the production tubing and said at least one control line substantially along a full length thereof;

said at least one control line having greater tensile strength in the longitudinal direction than the production tubing and the unitary casing such that said at least one control line provides greater support to suspend the rotary pump and the submersible pump driver in the well casing than the production tubing.

15. The support member according to claim 14 wherein the production tubing comprises a plastic material having greater corrosion resistance and having a lower coefficient of friction than steel production tubing.

16. The method according to claim 14 wherein the unitary casing comprises an integral elastomeric material.

17. The method according to claim 14 wherein the steel conduits are positioned on diametrically opposing sides of the production tubing such that respective central axes of the production tubing and the two steel conduits are aligned in a common plane, and wherein the unitary casing comprises a central body portion locating the production tubing centrally therein and a pair of side body portions locating the two steel conduits respectively therein at diametrically opposing sides of the central body portion, the side body portions having a reduced thickness in a direction perpendicular to the common plane in relation to the central body portion.

18. The support member according to claim 17 wherein a diameter of the production tubing is greater than a diameter of each steel conduit and wherein the casing has a substantially uniform thickness about each of the production tubing and the two steel conduits.

* * * * *